US010029360B2

(12) United States Patent
Sun

(10) Patent No.: US 10,029,360 B2
(45) Date of Patent: Jul. 24, 2018

(54) PALM RATCHET TOOL

(71) Applicant: SHANGHAI EASY-USE TOOLS ENTERPRISE CO., LTD., Shanghai (CN)

(72) Inventor: Shiyu Sun, Shanghai (CN)

(73) Assignee: SHANGHAI EASY-USE TOOLS ENTERPRISE CO., LTD, Shanghai (CN)

( * ) Notice: Subject to any disclaimer, the term of this patent is extended or adjusted under 35 U.S.C. 154(b) by 306 days.

(21) Appl. No.: 15/031,665

(22) PCT Filed: Feb. 11, 2015

(86) PCT No.: PCT/CN2015/072744
§ 371 (c)(1),
(2) Date: Apr. 22, 2016

(87) PCT Pub. No.: WO2016/050029
PCT Pub. Date: Apr. 7, 2016

(65) Prior Publication Data

US 2016/0263736 A1 Sep. 15, 2016

(30) Foreign Application Priority Data

Sep. 30, 2014 (CN) ..... 2014 2 05744494

(51) Int. Cl.
*B25G 1/08* (2006.01)
*B25B 13/46* (2006.01)

(52) U.S. Cl.
CPC ..... *B25G 1/085* (2013.01); *B25B 13/463* (2013.01); *B25B 13/465* (2013.01)

(58) Field of Classification Search
CPC ..... B25G 1/085; B25B 13/462; B25B 13/463; B25B 13/465
See application file for complete search history.

(56) References Cited

U.S. PATENT DOCUMENTS 5,967,003 A 10/1999 Lin
6,263,766 B1 * 7/2001 Jarvis ..... B25B 23/0021 81/177.2

(Continued)

FOREIGN PATENT DOCUMENTS

CN 200977635 Y 11/2007
CN 202964507 U 6/2013
WO WO 01/70467 A1 9/2001

*Primary Examiner* — David B Thomas
(74) *Attorney, Agent, or Firm* — Muncy, Geissler, Olds & Lowe, P.C.

(57) ABSTRACT

A palm ratchet tool includes an upper cover, a lower cover, a ratchet, a ratchet switch, and sockets. The upper cover is provided with through holes. The sockets are disposed in the through holes, respectively. The ratchet switch is disposed between the upper and lower covers. The ratchet switch includes a left detent, a right detent, and a pendular rod connected with the left and right detents. The lower cover is connected with the bottoms of the sockets. The top end of the pendular rod passes through the lower surface of the lower cover. The ratchet is disposed on the outer rims of the upper and lower covers. The inner surface of the ratchet is provided with a ratchet wheel. The ratchet switch is disposed close to the ratchet. The left detent or the right detent engages with the ratchet wheel under the action of the pendular rod.

4 Claims, 2 Drawing Sheets

(56) References Cited

U.S. PATENT DOCUMENTS

| | | | | |
|---|---|---|---|---|
| 6,286,395 | B1 * | 9/2001 | Frazier | B25B 13/005 81/124.7 |
| D672,957 | S * | 12/2012 | Christopher | B25G 1/085 D3/284 |
| 9,669,525 | B2 * | 6/2017 | Tsai | B25B 23/0028 |
| 2006/0060033 | A1 * | 3/2006 | Warner | B25B 13/46 81/60 |
| 2011/0226098 | A1 * | 9/2011 | Zhang | B25B 15/02 81/177.4 |
| 2014/0013904 | A1 * | 1/2014 | Meholovitch | B25B 13/463 81/63.2 |
| 2014/0060258 | A1 * | 3/2014 | Anders | B25B 13/465 81/60 |
| 2014/0069236 | A1 | 3/2014 | Liu | |
| 2014/0165293 | A1 | 6/2014 | Hermansen et al. | |
| 2016/0279780 | A1 * | 9/2016 | Sun | B25F 1/04 |

* cited by examiner

PALM RATCHET TOOL

BACKGROUND OF THE INVENTION

1. Field of the Invention

The present invention relates to a palm ratchet tool.

2. Description of the Prior Art

A conventional wrench is used to tighten or loosen a bolt or a nut. For convenient use, a wrench having a ratchet device is developed on the market accordingly, which can change the turning direction during use. However, when this wrench is applied to a workpiece in a different size, it is necessary to replace a wrench of a different size. Thus, the user needs many sets of tools during repair. This is inconvenient for carrying and increases the cost of maintenance.

Accordingly, the inventor of the present invention has devoted himself based on his many years of practical experiences to solve these problems.

SUMMARY OF THE INVENTION

The primary object of the present invention is to provide a palm ratchet tool to effectively solve the aforesaid shortcomings of the prior art.

In order to achieve the aforesaid object, the palm ratchet tool of the present invention comprises an upper cover, a lower cover, a ratchet, a ratchet switch, and sockets. The upper cover is provided with a plurality of through holes. The sockets are disposed in the through holes, respectively. The ratchet switch is disposed between the upper cover and the lower cover. The ratchet switch comprises a left detent, a right detent, and a pendular rod connected with the left detent and the right detent. The lower cover is connected with the bottoms of the sockets. The top end of the pendular rod passes through the lower surface of the lower cover. The ratchet is disposed on the outer rims of the upper cover and the lower cover. The inner surface of the ratchet is provided with a ratchet wheel. The ratchet switch is disposed close to the ratchet. The left detent or the right detent engages with the ratchet wheel under the action of the pendular rod.

Preferably, the palm ratchet tool further comprises a screwdriver rod retaining member. The screwdriver rod retaining member is disposed between the upper cover and the lower cover. The screwdriver rod retaining member comprises a base and a raised retaining portion. The retaining portion extends out of the lower surface of the lower cover.

Preferably, the palm ratchet tool further comprises a screwdriver rod. One end of the screwdriver rod is connected with the retaining portion of the screwdriver rod retaining member through a sleeve. Another end of the screwdriver rod is provided with a receiving rod for connecting with the sockets. The upper surface of the upper cover is provided with an accommodation trough to accommodate the screwdriver rod.

Preferably, the lower surface of the lower cover is provided with an opening. The opening corresponds to a portion of the bottom of each socket.

The palm ratchet tool of the present invention has a plurality of sockets. When in use, the sockets can be replaceable according to the actual use. The present invention can be carried conveniently and lower the cost of maintenance.

DETAILED DESCRIPTION OF THE PREFERRED EMBODIMENTS

Embodiments of the present invention will now be described, by way of example only, with reference to the accompanying drawings.

Figure 1:
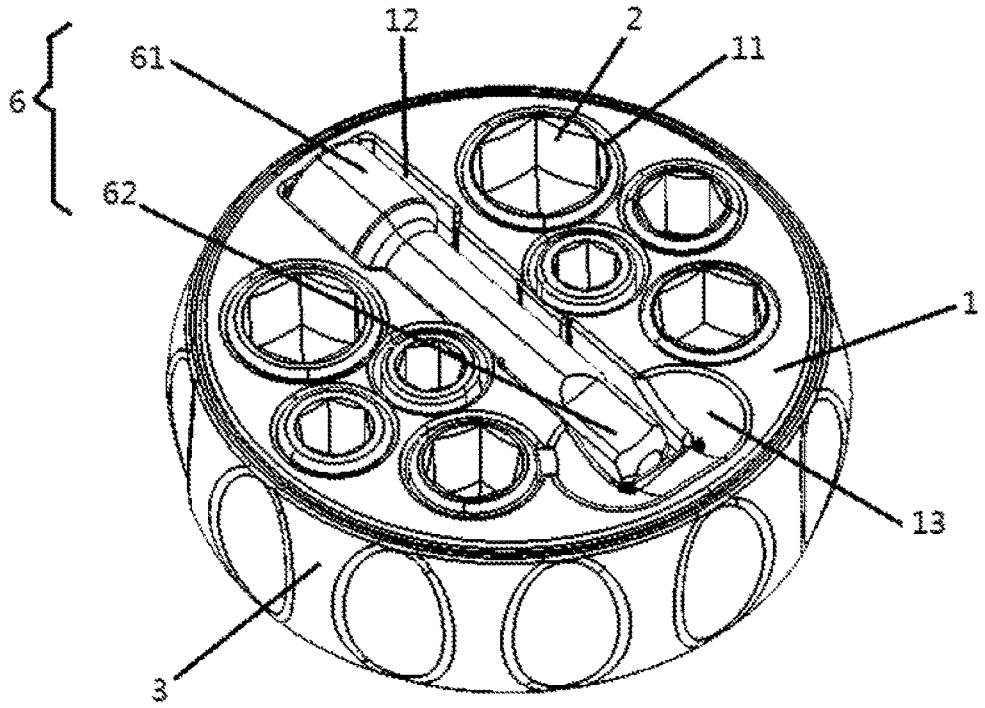
FIG. 1 is a perspective view according to a preferred embodiment of the present invention.
Figure 2:
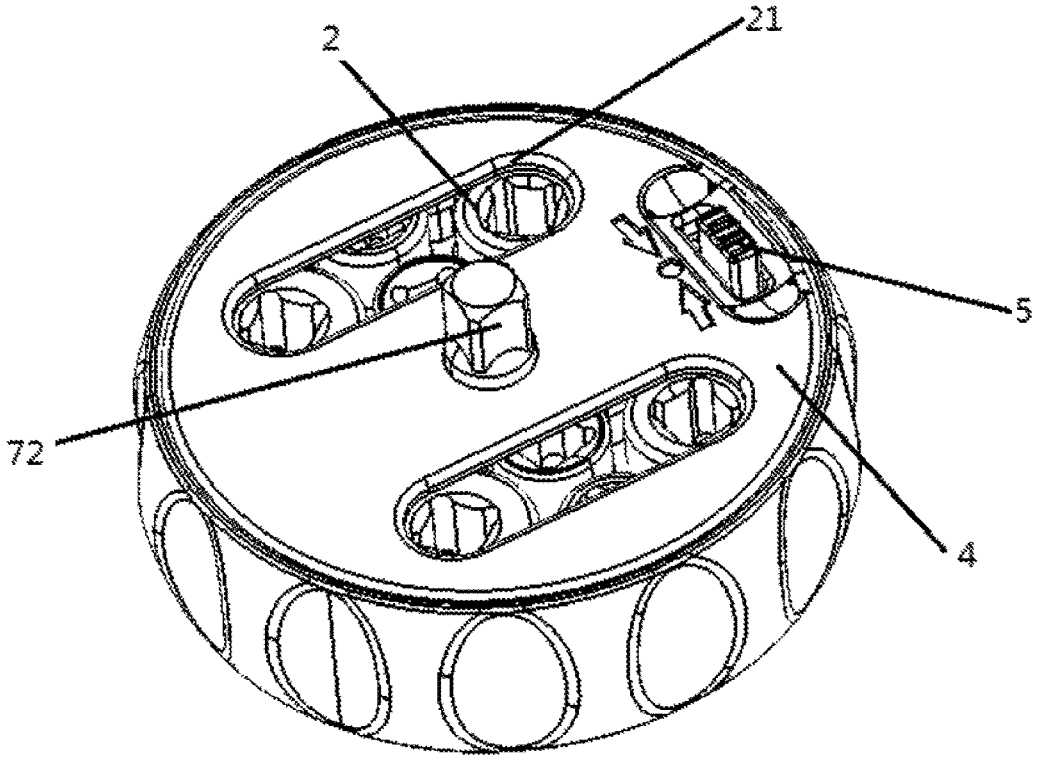
FIG. 2 is a perspective view of FIG. 1.
Figure 3:
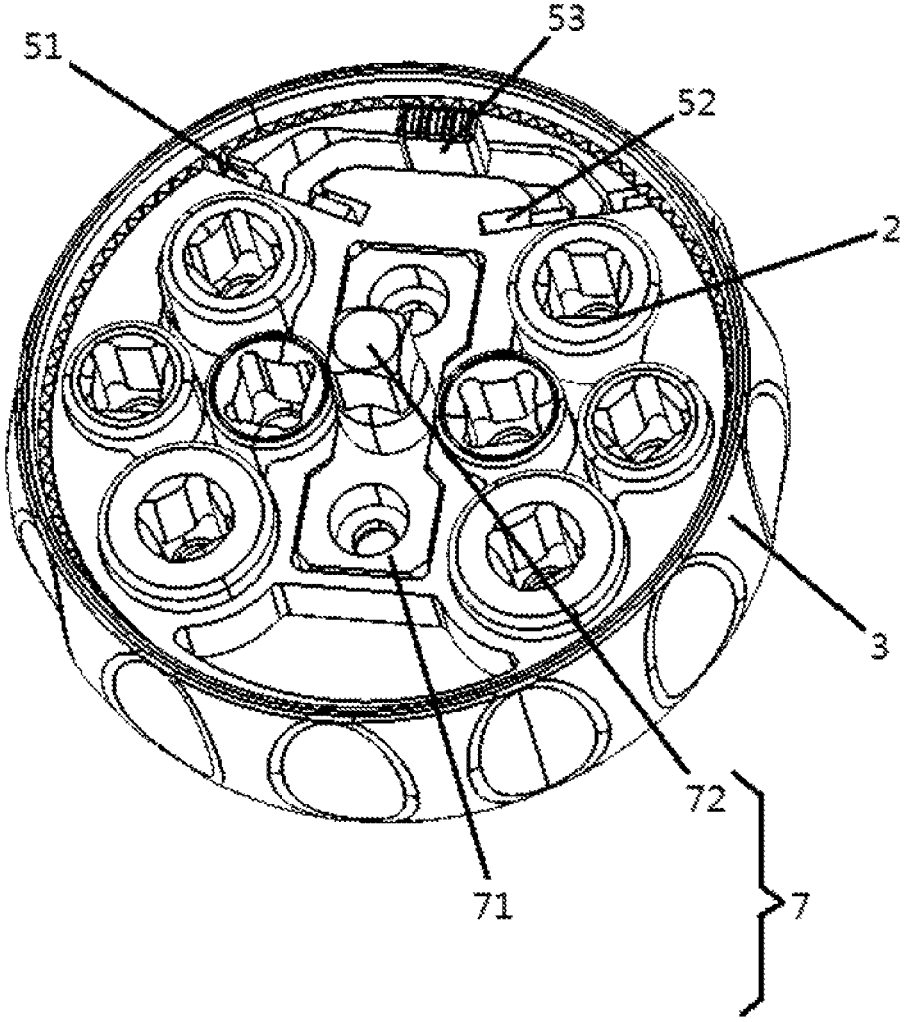
FIG. 3 is a perspective view showing the interior structure of the preferred embodiment of the present invention.

FIG. 1 is a perspective view according to a preferred embodiment of the present invention. FIG. 2 is a perspective view of FIG. 1. FIG. 3 is a perspective view showing the interior structure of the preferred embodiment of the present invention. A palm ratchet tool according to the preferred embodiment of the present invention comprises an upper cover 1, a lower cover 4, a ratchet 3, a ratchet switch 5, and sockets 2.

The upper cover 1 is provided with a plurality of through holes 11. In this embodiment, the upper surface of the upper cover is a flat configuration. The upper surface of the upper cover is provided with an accommodation trough 12 to accommodate a screwdriver rod 6. The accommodation trough 12 is disposed at the middle of the upper surface of the upper cover. In order to take the screwdriver rod conveniently, one end of the accommodation trough is formed with a recess 13.

The sockets 2 are disposed in the through holes 11, respectively. The size and the shape of the sockets may be different from one another. They can be replaceable according to the actual demand. This is convenient to use and carry. The sockets are evenly arranged at the two sides of the accommodation trough. This arrangement is neat and tidy and is pleasing the eye.

In this embodiment, the ratchet switch 5 is disposed between the upper cover 1 and the lower cover 4. The ratchet switch 5 comprises a left detent 51, a right detent 52, and a pendular rod 53 connected with the left detent and the right detent. The ratchet 3 is disposed on the outer rims of the upper cover 1 and the lower cover 4. The inner surface of the ratchet is provided with a ratchet wheel. The ratchet switch 5 is disposed close to the side of the ratchet. The left detent or the right detent engages with the ratchet wheel under the action of the pendular rod. The turning direction of the ratchet can be adjusted through the ratchet switch 5. In addition, because of the positions of the ratchet and the ratchet switch, the operator just turns the ratchet disposed at the periphery of the ratchet tool when in use. There is no need to turn the whole ratchet tool. It is convenient for operation.

The lower cover 4 is connected with the bottoms of the sockets. The top end of the pendular rod 53 passes through the lower surface of the lower cover. The top end of the pendular rod exposed out of the lower cover is adjusted left or right to bring motion of the left detent or the right detent so as to change the turning direction of the ratchet. In order to take out each socket easily, the lower cover 4 is provided with an opening 21. The opening corresponds to a portion of the bottom of each socket, such that the bottom the socket can be secured and the socket can be taken conveniently by means of one side of the opening.

The ratchet tool of this embodiment further comprises a screwdriver rod retaining member 7 and a screwdriver rod 6. The screwdriver rod retaining member 7 is disposed between the upper cover 1 and the lower cover 4. The screwdriver rod retaining member 7 comprises a base 71 and a raised retaining portion 72. The retaining portion 72 extends out of the lower surface of the lower cover. The retaining portion is used to connect the screwdriver. One end of the screwdriver rod 6 is connected with the retaining portion 72 of the screwdriver rod retaining member through a sleeve. Another end of the screwdriver rod 6 is provided with a receiving rod 62 for connecting with the sockets.

When in use, the screwdriver rod is taken out, and then the screwdriver rod is secured on the retaining portion 72 of the screwdriver rod retaining member 7. A desired socket is pushed out through one side of the opening. The socket is secured on the receiving rod at the other end the screwdriver rod. The socket is placed on a bolt or a nut to tighten or loosen the bolt or the nut. The bolt or the nut is rotated and tightened by tuning the ratchet through the adjustment of the ratchet switch.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A palm ratchet tool, comprising an upper cover, a lower cover, a ratchet, a ratchet switch, and sockets;

the upper cover being provided with a plurality of through holes;

the sockets being disposed in the through holes, respectively;

the ratchet switch being disposed between the upper cover and the lower cover, the ratchet switch comprising a left detent, a right detent, and a pendular rod connected with the left detent and the right detent;

the lower cover being connected with bottoms of the sockets, a top end of the pendular rod passing through a lower surface of the lower cover;

the ratchet being disposed on outer rims of the upper cover and the lower cover, an inner surface of the ratchet being provided with a ratchet wheel, the ratchet switch being disposed close to the ratchet, the left detent or the right detent engaging with the ratchet wheel under the action of the pendular rod.

2. The palm ratchet tool as claimed in claim 1, further comprising a screwdriver rod retaining member, the screwdriver rod retaining member being disposed between the upper cover and the lower cover, the screwdriver rod retaining member comprising a base and a raised retaining portion, the retaining portion extending out of the lower surface of the lower cover.

3. The palm ratchet tool as claimed in claim 1, further comprising a screwdriver rod, one end of the screwdriver rod being connected with the retaining portion of the screwdriver rod retaining member through a sleeve, another end of the screwdriver rod being provided with a receiving rod for connecting with the sockets, an upper surface of the upper cover being provided with an accommodation trough to accommodate the screwdriver rod.

4. The palm ratchet tool as claimed in claim 1, wherein the lower surface of the lower cover is provided with an opening, and the opening corresponds to a portion of the bottom of each socket.

* * * * *